United States Patent [19]

Horodysky et al.

[11] Patent Number: 4,599,183

[45] Date of Patent: Jul. 8, 1986

[54] MULTIFUNCTIONAL ADDITIVES

[75] Inventors: Andrew G. Horodysky, Cherry Hill; Joan M. Kaminski, Mullica Hill; Henry Ashjian, E. Brunswick; Henry A. Gawel, Clark, all of N.J.

[73] Assignee: Mobil Oil Corporation, New York, N.Y.

[21] Appl. No.: 533,728

[22] Filed: Sep. 19, 1983

[51] Int. Cl.[4] ..... C10M 1/32; C10M 1/48

[52] U.S. Cl. ..... 252/32.7 E; 252/40.5; 252/42; 252/49.6; 564/8

[58] Field of Search ..... 252/32.7 E, 49.6, 40.5, 252/42; 564/8

[56] References Cited

U.S. PATENT DOCUMENTS

| | | | |
|---|---|---|---|
| 4,025,445 | 5/1977 | Hellmuth et al. | 252/49.6 |
| 4,303,540 | 12/1981 | Schuster et al. | 252/49.6 |
| 4,328,113 | 5/1982 | Horodysky et al. | 252/49.6 |

*Primary Examiner*—Jacqueline V. Howard
*Attorney, Agent, or Firm*—Alexander J. McKillop; Michael G. Gilman; Howard M. Flournoy

[57] ABSTRACT

Alkyl triamine borates are effective multifunctional friction reducing and high temperature stabilizing additives when incorporated into hydrocarbyl lubricants and fuels.

25 Claims, No Drawings

MULTIFUNCTIONAL ADDITIVES

BACKGROUND OF THE INVENTION

1. Field of the Invention

This invention relates to lubricant compositions and more particularly to lubricant compositions comprising oils of lubricating viscosity and greases thereof containing a minor effective amount of a multifunctional additive comprising a hydrocarbyl triamine borate adduct or mixtures thereof.

2. Description of Prior Art

Many means have been employed to reduce overall friction in modern engines, particularly in internal combustion engines. The primary reasons are to reduce engine wear, prolong engine life and to reduce fuel consumption thereby reducing the engine'energy requirement.

Many of the solutions to this problem have been strictly mechanical. As for example, setting the engines for a leaner burn or building smaller cars and smaller engines. However, considerable work has also been done to enhance the friction properties of lubricating oils by modifying them, for example with friction reducing additives.

Amines and amine adducts have found widespread use as additives in lubricant oils and greases, and fuels. For example, U.S. Pat. No. 4,328,113 is directed to the use of certain borated adducts of hydrocarbyl mono or diamines in lubricants. It has now been found that selected hydrocarbyl triamine borates possesses significant friction modifying characteristics and also have the ability to significantly improve the high temperature stabilization and corrosion inhibiting properties of various hydrocarbon lubricants and fuels.

SUMMARY OF THE INVENTION

This invention is particularly directed to partially or completely borated hydrocarbyl triamines wherein hydrocarbyl includes alkyl, cycloalky, aryl and alkaryl having from eight to about thirty carbon atoms. The alkyl triamine borates in accordance with the invention are novel and have been found to be effective multifunctional additives providing friction reducing, high temperature stabilizing and some corrosion inhibiting properties and detergency/dispersency improvement when blended into hydrocarbyl lubricants or fuels.

This invention is also directed to lubricant compositions containing the subject triamine borates and to a method of reducing fuel consumption in internal combustion engines by treating the moving surfaces of the engine with said lubricant compositions. This invention is also further directed to lubricant compositions where improved oxidative and high temperature stability and reduced corrosion are provided by the borated adducts embodied in this invention.

DESCRIPTION OF SPECIFIC EMBODIMENTS

The triamines useful herein may generally be described as long chain N-hydrocarbyl alkylene triamines having the generalized structure described below:

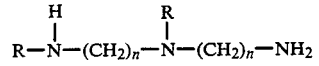

$$R-\overset{H}{\overset{|}{N}}-(CH_2)_n-\overset{R}{\overset{|}{N}}-(CH_2)_n-NH_2$$

where R can be hydrogen or $C_8$–$C_{30}$ hydrocarbyl with the proviso that at least one R must be hydrocarbyl and n is 2 or 3. $C_8$–$C_{30}$ hydrocarbyl groups useful include oleyl, stearyl, tallow, isostearyl, hydrogenated tall oil, coco, soya, lauryl, decyl, tetradecyl, pentadecyl, linoleyl, hexadecyl and mixtures thereof.

The triamines can be partially borated or a stoichiometric quantity of borating agent can be used to obtain completely borated triamines. In some cases an excess of borating agent of up to 100% to 200% excess maybe desirable. Boric acid, metaborates, or trialkyl borates are typical borating agents. Any suitable reaction conditions known to the art may be used in the preparation of these borated adducts. However, reaction temperatures can vary from about 100° C. to about 260° C. with about 110° C. to about 170° C. being preferred. Ambient pressures or higher may be used as desired. Solvents may be used if desired. Suitable solvents include reactive or nonreactive solvents. Nonreactive solvents include benzene, toluene, xylene and the like; suitable reactive solvents include isopropanol, butanol, pentanols, hexamethylene glycol, and the like.

The lubricants contemplated for use herein include both mineral and synthetic hydrocarbon oils of lubricating viscosity, mixtures of mineral and synthetic oils and greases prepared therefrom. Typical synthetic oils are: polypropylene, polypropylene glycol, trimethyl propane esters, neopentyl and pentaerythritol esters, di(2-ethylhexyl) sebacate, di(2-ethylhexyl) adiptate, dibutyl phthalate, polyethylene glycol, di(2-ethylhexanoate), fluorocarbons, perfluoro-alkyl-polyesters, silicate esters, silanes, esters of phosphorus-containing acids, liquid ureas, ferrocene derivatives hydrogenated mineral oils, chain-type polyphenols, siloxanes and silicones (polysiloxanes), alkyl-substituted diphenyl ethers typified by a butyl-substituted bis-(p-phenoxy phenyl) ether, phenoxy phenylether, etc.

The amount of additive to be added to the lubricant compositions to be effective may range from 0.1 to about 10% by weight of the total lubricant composition. Preferred is from about 0.5 to 5 wt. %

A specific level of boration is not critical to obtain maximum benefits. The level of boron in the final product should be at least 0.20%, but could be up to 12% or more. The preferred boron content is in the range of 0.1% to 8%. Such borated compounds are used with lubricating oils and greases at from about 0.1% to about 10% by weight of the total composition and may be used along with other additives, such as detergents, corrosion inhibitors, antioxidants, antiwear agents, extreme pressure agents, viscosity index improvers, pour depressants, dispersants, and the like. These can include phenates, sulfonates, succinimides, metallic nickel, calcium or zinc, dialkyl or diaryl or ashless dithiophosphates, including vinyl ether, vinyl ester or alkoxide adducts of dithiophorodithio acids, phosphorothionyl disulfides, phosphites, sulfides, disulfide polymers, calcium and magnesium salts and the like. Enhancement of frictional and high temperature stabilizer performance properties is often greatest in lubricants containing one or more of the above-mentioned dithiophosphates at concentrations of from about 0.1% to 5%, preferably 0.25% to 2% by weight. The dithiophosphates can be derived by the reaction of alcohols or phenols such as isopropanol, butanols, pentanols, hexanols, octanols, octadecanols, nonyl phenol, octyl phenol, dodecyl phenol, butyl phenol or mixtures thereof with a phosphorus polysulfide such as phosphorus pentasulfide.

An important feature of the invention is the ability of the additive compounds to improve the resistance to oxidation of oleaginous materials such as lubricating oils, either mineral oils or synthetic oils, or mixtures thereof, or a grease in which any of the aforementioned oils are employed as a vehicle. In general, mineral oils, both paraffinic, naphthenic and mixtures thereof, employed as a lubricating oil or the grease vehicle, may be of any suitable lubricating viscosity range, as for example, from about 45 SSU at 100° F. to about 6000 SSU at 100° F., and preferably from about 50 to about 250 SSU at 210° F. These oils may have viscosity indexes ranging to about 100 or higher. Viscosity indexes from about 70 to about 95 are preferred. The average molecular weight of these oils may range from about 250 to about 800. Where the lubricant is to be employed in the form of a grease, the lubricating oil is generally employed in an amount sufficient to balance the total grease composition, after accounting for the desired quantity of the thickening agent, and other additive components to be included in the grease formulation.

A wide variety of materials may be employed as thickening or gelling agents. These may include any of the conventional metal salts or soaps, including calcium or lithium soaps, which are dispersed in the lubricating vehicle in grease-forming quantities in an amount to impart to the resulting grease composition the desired consistency. Other thickening agents that may be employed in the soap thickeners can include calcium or lithium stearates or calcium or lithium hydroxy stearates. Included are greases thickened by the use of at least a portion of metallic hydroxy stearate thickener, which can be made by the reaction of lithium hydroxide with 12-hydroxystearic acid, or the corresponding methyl esters or glycerides. Grease formulation may also utilize the non-soap thickeners, such as surface-modified clays and silicas, aryl ureas, calcium complexes and similar materials. In general, grease thickeners are employed which do not melt and dissolve when used at the required temperature within a particular environment; however, in all other respects, any material which is normally employed for thickening or gelling hydrocarbon fluids for forming grease can be used in preparing the aforementioned improved greases in accordance with the present invention. Included among the preferred thickening agents are those containing at least a portion of alkali and alkaline earth metal soaps of hydroxyl-containing fatty acids and fatty glycerides, and fatty esters having from 12 to about 30 carbon atoms per molecule. The metals are typified by sodium, lithium, calcium and barium. Perferred is lithium. One of the preferred members among these acids and fatty materials is 12-hydroxystearic acid, and glycerides containing 12-hydroxystearates. The entire thickener need not be derived from the aforementioned thickeners, but for significant benefit, at least a portion (greater than 10–20% of the thickener, should be derived from the above-mentioned metal hydroxyl-containing soap thickeners. Other thickeners that can be used in conjunction include: alkaline earth metal soapes of methyl 12-hydroxystearic acids, diesters of $C_4$–$C_{12}$ dibasic acids or dibasic acid esters.

Having described the invention in general terms, the following are offered to specifically illustrate this development. It is to be understood they are illustrations only and that the invention is not thereby limited except as by the appended claims.

Generally speaking the subject amine compounds are obtained from standard commerical sources or they may be prepared and/or borated by any of a number of conventional methods known in the art.

The following examples are typical of the additive compounds useful herein and their test data serve to demonstrate their effectiveness in lubricant compositions for reducing friction and conserving fuel. It is to be understood that the compositions contemplated herein may also contain other materials. For example, other corrosion inhibitors, extreme pressure agents, viscosity index improvers, coantioxidants, antiwear agents and the like can be used. These include, but are not limited to, phenates, sulfonates, succinimides, zinc dialkyl, or diaryl, dithiophosphates and the like.

EXAMPLE 1

Borated Oleyl Triamine

Approximately 108 g N-oleyl-dipropylene traimine (obtained commercially—Armak Co), 100 g toluene and 15 g boric acid were charged to a 1 liter reactor equipped with agitator, heater, Dean-Stark tube with condenser and provision for blanketing the vapor space with nitrogen. The reactor contents were heated to 160° C. over a period of 4 hours until water evolution during azeotropic distillation ceased. The solvent was removed by vacuum distillation. The product was cooled to 100° C. and filtered through diatomaceous earth to form an amber liquid which became waxy after cooling.

EXAMPLE 2

Partially Borated Tallow Triamine

Approximately 216 g of N-tallow-dipropylene triamine (obtained commercially—Armak Co), 100 g toluene and 8 g boric acid were reacted as generally described in Example 1. The reactor contents were heated to 160° C. for a period of 4½ hours until water evolution during azeotropic distillation ceased. The solvent was removed by azeotropic distillation. The product was cooled to 130° C. and filtered through diatomaceous earth.

EXAMPLE 3

Borated Tallow Triamine

Approximately 216 g of N-tallow-dipropylene triamine (obtained commerically—Armak Co), 100 g toluene and 15 g acid were reacted as generally described in Example 1. The reactor contents were heated to 160° C. over a period of 5 hours until water evolution during azeotropic distillation ceased. The solvent was removed by vacuum distillation at 160° C. The product was cooled to 130° C. and filtered through diatomaceous earth. The product was an amber liquid which became waxy upon cooling.

EXAMPLE 4

Borated Tallow Triamine

Approximately 216 g of N-tallow-dipropylene triamine (obtained commercially—Armak Co), 100 g toluene and 22 g boric acid were reacted as generally described in Example 1. The reactor contents were heated to 170° C. over a period of 3½ hours until water evolution during azeotropic distillation ceased. The solvent was removed by vacuum distillation at 170° C. The product was cooled to 120° C. and filtered through diatomaceous earth.

The additives in accordance with this invention were blended into fully formulated synthetic and mineral oil based lubricants containing polymeric dispersants, metallic phenates and sulfonates, zinc dithiophosphates and polymeric viscosity index improvers, and evaluated for frictional properties using the Low Viscosity Friction Apparatus Test (LVFA). This test is fully described in U.S. Pat. No. 4,328,113 which is incorporated herein in its entirety. As can be seen in Tables 1 and 2, the borated traimines of the invention reduced the coefficients of friction by up to about 40%.

In order to evaluate the friction modifying effectiveness of compositions as disclosed in the present invention the additives identified in Tables 1 and 2 below were tested in accordance with the above-mentioned friction evaluation procedure.

TABLE 1

Frictional Properties Using Low Velocity Friction Apparatus Test

| | Concentration In Test Oil, Wt. % | Percent Reduction In Coefficient of Friction 5 Ft./Min. | 30 Ft./Min. |
|---|---|---|---|
| Base Oil-Fully formulated SAE 10W-40 automotive engine oil containing detergent/dispersant/Zinc dithiophosphate inhibitor performance package | — | 0 | 0 |
| Example 1 Borated Oleyl Triamine | 2 | 40 | 32 |
| Example 2 Borated Tallow Triamine | 2 | 40 | 31 |
| Example 4 Borated Tallow Triamine | 2 | 34 | 22 |

TABLE 2

Frictional Properties Using Low Velocity Friction Apparatus Test

| | Concentration In Test Oil, Wt. % | Percent Reduction In Coefficient of Friction 5 Ft./Min. | 30 Ft./Min. |
|---|---|---|---|
| Base Oil-Fully formulated SAE 10W-30 synthetic automotive engine oil containing detergent/dispersant/zinc dithiophosphate inhibitor performance package | | | |
| Example 3 Borated Tallow Triamine | 2 | 35 | 28 |
| Example 2 Borated Tallow Triamine | 2 | 40 | 31 |
| Example 4 Borated Tallow Triamine | 2 | 34 | 22 |

The high temperature oxidative stability properties of these additives were tested using the Catalytic Oxidation Test at 325° F. as shown in Table 3. Appreciable control of viscosity increase and control of generation of acidity were demonstrated.

Catalytic Oxidation Test

A sample of the base lubricant is placed in an oven at a desired temperature. Present in the sample are the following metals either known to catalyze organic oxidation or commonly used materials of construction.

a. 15.6 sq. in. of sand-blasted iron wire, b. 0.78 sq. in. of polished copper wire, c. 0.87 sq. in. of polished aluminum wire and d. 0.167 sq. in. of polished lead surface.

Dry air is passed through the sample at a rate of about 5 liters per hour.

TABLE 3

Catalytic Oxidation Test 325° F., 40 Hours

| | Conc. Wt. % | Neut. Number | Lead Loss, mg | Change in Viscosity Measured @ 100° C., % |
|---|---|---|---|---|
| Base Oil - 200" solvent paraffinic neutral lubricating oil | | 3.62 | 1.2 | 67 |
| Example 1 Borated Oleyl Triamine | 1 | 4.20 | 0.0 | 40 |
| Example 2 Partially Borated Tallow Triamine | 1 | 3.66 | 0.8 | 22 |
| Example 3 Borated Tallow Triamine | 0.5 | 3.54 | 0.5 | 22 |
| Example 4 Borated Tallow Triamine | 1 | 3.29 | — | 21 |
| | 0.5 | 3.16 | 0.2 | 21 |
| | 1 | 3.86 | 1.0 | 21 |
| | 0.5 | 3.49 | 0.3 | 21 |

The use of borated adducts of hydrocarbyl triamines and premium quality lubricants, greases and fuels improve the fuel economy properties and high temperature stabilizing characteristics without compromising other critical performance properties. As clearly confirmed by the data detailed hereinabove, and although the present invention has been described with preferred embodiments, it is to be understood that modification and variations may be resorted to, without departing from the spirit and scope of this invention, as those skilled in the art will readily understand. Such modifications and variations are considered to be within the purview and scope of the appended claims.

We claim:

1. A lubricant composition comprising a major proportion of an oil of lubricating viscosity or grease or other solid lubricant prepared therefrom and a minor effective proportion of a multifunctional friction reducing/high temperature stabilizing additive compound consisting of a $C_8$ to $C_{30}$ hydrocarbyl triamine borate adduct or mixtures thereof.

2. The composition of claim 1 wherein the oil of lubricating viscosity is selected from mineral oils or fractions thereof, synthetic oils or mixtures of mineral and synthetic oils.

3. The composition of claim 2 wherein the additive is borated oleyl triamine.

4. The composition of claim 2 wherein the additive is partially borated tallow triamine.

5. The composition of claim 2 wherein the additive is borated tallow triamine.

6. The composition of claim 3 wherein said oil of lubricating viscosity is a mineral oil.

7. The composition of claim 4 wherein said oil of lubricating viscosity is a mineral oil.

8. The composition of claim 5 wherein said oil of lubricating viscosity is a mineral oil.

9. The composition of claim 3 wherein said oil of lubricating viscosity is a synthetic oil.

10. The composition of claim 4 wherein said oil of lubricating viscosity is a synthetic oil.

11. The composition of claim 5 wherein said oil of lubricating viscosity is a synthetic oil.

12. The composition of claim 1 wherein said major proportion is a grease.

13. The composition of claim 1 containing from about 0.1 to about 10 wt. % of said multifunctional additive.

14. The composition of claim 13 containing from about 0.5 to about 3 wt. % of said multifunctional additive.

15. The composition of claim 12 wherein said grease has been thickened by a thickening agent selected from the group consisting of alkali and alkaline earth metal soaps of hydroxyl-containing fatty acids fatty glycerides and fatty esters having from about 12 to about 30 carbon atoms per molecule, surface modified clays and silicas, aryl ureas, calcium complexes and diesters of $C_4$–$C_{12}$ dibasic acids or dibasic acid esters or mixtures thereof.

16. The composition of claim 15 wherein the thickening agent is an alkali or alkaline earth metal of said hydroxyl containing fatty acids and the metal component is selected from sodium, lithium, barium and calcium.

17. The composition of claim 15 wherein the fatty acids are selected from 12-hydroxystearic acid and glycerides containing 12-hydroxystearates.

18. The composition of claim 15 wherein at least a portion of the thickening agent employed is a calcium or lithium 12-hydroxystearic acid or the corresponding methyl esters or glycerides thereof.

19. The composition of claim 1 comprising in addition to said oil of lubricating viscosity or grease prepared therefrom one or more members of the group selected from metallic or ashless phosphorodithioates, zinc dialkyl or diaryl phosphorodithioate, vinyl ethers and vinyl esters or alkoxide adducts of dithiophosphorodithioates.

20. A fully or partially borated adduct of a N-hydrocarbyl alkylene triamine having the following generalized formula

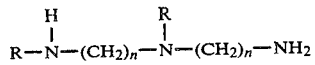

where both R's can be the same or different and can be H or $C_8$–$C_{30}$ hydrocarbyl with the proviso that at least one R must be hydrocarbyl and n is 2 or 3.

21. The borated adduct of claim 20 where said $C_8$–$C_{30}$ hydrocarbyl moiety is selected from the group consisting of oleyl, stearyl, isostearyl, tallow, hydrogenated tallow, coco, soya, lauryl, decyl, tetradecyl, pentadecyl, hexadecyl, linoleyl, and mixtures thereof.

22. A partially borated tallow triamine adduct in accordance with claim 21.

23. A fully borated triamine in accordance with claim 21.

24. A borated oleyl triamine in accordance with claim 21.

25. A method of reducing the friction between the moving parts of internal combustion engines thereby reducing said engine's fuel consumption comprising incorporating a minor effective friction reducing and high temperature stabilizing amount of a borated hydrocarbyl triamine as defined in claim 1 whereby friction reducing characteristics are imparted to said lubricant composition and thereafter treating said internal combustion engine therewith.

* * * * *